US006604737B1

(12) United States Patent
Garrett

(10) Patent No.: US 6,604,737 B1
(45) Date of Patent: Aug. 12, 2003

(54) UTILITY WORKSTATION

(76) Inventor: Roger T. Garrett, 1217 E. Amazon Ave., Portales, NM (US) 88130

( * ) Notice: Subject to any disclaimer, the term of this patent is extended or adjusted under 35 U.S.C. 154(b) by 0 days.

(21) Appl. No.: 09/660,236

(22) Filed: Sep. 12, 2000

Related U.S. Application Data

(62) Division of application No. 09/038,485, filed on Mar. 7, 1998, now Pat. No. 6,142,459.

(51) Int. Cl.[7] ..... B25B 1/00

(52) U.S. Cl. ..... 269/11; 269/16; 269/17; 269/69; 362/253; 362/97

(58) Field of Search ..... 269/11, 16, 17, 269/69, 71, 45, 909; 362/253, 97, 127; 112/258, 260; 38/102.1

(56) References Cited

U.S. PATENT DOCUMENTS 2,181,133 A * 11/1939 Katz ..... 88/24
2,669,958 A * 2/1954 Sweeney ..... 269/71 X
4,145,006 A * 3/1979 Webb ..... 269/71 X
4,183,511 A * 1/1980 Marek ..... 269/71 X
4,549,366 A * 10/1985 Gerding et al. ..... 269/71 X
5,141,211 A * 8/1992 Adams ..... 269/16 X
5,999,340 A * 12/1999 Goff et al. ..... 359/804
D424,591 S * 5/2000 Goff et al. ..... D16/135
6,099,093 A * 8/2000 Spence ..... 312/196
6,142,459 A * 11/2000 Garrett ..... 269/11 X
6,158,357 A * 12/2000 Shih ..... 108/50.01
6,269,753 B1 * 8/2001 Roddan ..... 108/50.01
6,298,794 B1 * 10/2001 Brown et al. ..... 108/50.01

* cited by examiner

*Primary Examiner*—Joseph J. Hail, III
*Assistant Examiner*—Daniel Shanley

(57) ABSTRACT

The utility workstation selectively positions a suspended workpiece before a typically seated operator. It is height adjustable and accepts various types of holding and support attachments that allow various kinds of workpieces to be positioned at various angles and rotations. It provides local light and magnifier sources as well as display and storage options for tools and supplies useful for working with a workpiece. It allows a workpiece to be moved laterally from a fully retracted position, where the workpiece is out of the way of someone getting out of or into his or her seat, to a working position, where the workpiece is suspended at a preferred location and orientation before the operator. It is designed to be operated from the left side or right side of a chair, easy chair, stool, couch, or other type of seating means.

22 Claims, 11 Drawing Sheets

UTILITY WORKSTATION

This application is a division of prior application Ser. No. Ser. No. 09/038,485, filed Mar. 7, 1998 U.S. Pat. No. 6,142,459.

BACKGROUND OF THE INVENTION

1. Field of the Invention

The claimed invention relates to a utility workstation for positioning various types of workpieces, and especially for positioning workpieces requiring adjustable vertical and/or horizontal rotation. The claimed invention further relates to a utility workstation employing display, storage, and local light and magnifier means.

2. Description of the Prior Art

The claimed invention is a utility workstation, which is herein defined as an adaptable workpiece positioning device for presenting a suspended workpiece before an operator. The claimed invention permits employing local light and magnifier sources and auxiliary components designed to facilitate the work process; auxiliary components being holders, supports, trays, storage units, and the like.

The work desk is a very familiar example of the basic workstation. We typically place the everyday things that we use to do our work either in, on, or about our desk, while we use the top of our desk to display and negotiate our work. We do this to maintain organization in our work affairs and to minimize our having to get up from our desk to find and use the basic tools and materials of our work. So it is with the utility workstation concept as applied in this document. Auxiliary components provide means for displaying and storing the tools and aids for the work to be performed and the positioning device provides means for displaying and negotiating the work itself.

How one might use the claimed invention is a function of the requirements of the work to be performed in much the same way that the nature of our work principally determines what we put in and on our desk; there are numerous applications which could be claimed for it. For example, the claimed invention is particularly useful for arts and crafts pursuits in that (1) it allows a hobbyist or artist to work while sitting, (2) it provides for an assortment of specialty holders and supports, (3) it allows an object or material to be presented in a variety of positions, (4) it provides local light and magnifier sources, and (5) it provides for various types of trays and containers for tools and supplies.

The claimed invention is a free-standing workpiece positioner that easily accommodates various seating means as it allows the workpiece to be swiveled away from the working position and out of the way of an operator leaving or entering his or her seat. The swivel action of the claimed invention is not found in the prior art.

Several U.S. patents include design aspects recognizable in the claimed invention under examination in this application. These include: Nolting, U.S. Pat. No. 1,432,725; Webb, U.S. Pat. No. 4,145,006; Dubbs et al., U.S. Pat. No. 4,771,980; and Adams, Jr., U.S. Pat. No. 5,141,211. Adams, Jr. is nearest in approximating some of the design concepts of the claimed invention but even it does not anticipate the swivel action of the claimed invention or its integration of auxiliary components into its overall structure as integral parts of the device rather than as add-on extras.

The ability to swivel the workpiece into and away from the working position and to match the auxiliary requirements for accomplishing a task with the basic and adaptive features of the claimed invention results in an exceptional tool for task-specific and general purpose utilization not present in the related prior art.

SUMMARY OF THE INVENTION

The overall object of the claimed invention is to provide a typically seated operator with means for positioning a suspended workpiece as needed, wherein the operator is allowed unencumbered access to a seating means by permitting the workpiece to be moved from a retracted position, where the workpiece is out of the entry and exit path, to a working position, where the workpiece is at a preferred location and orientation for working. The claimed invention includes local light and magnifier sources as well as means for incorporating auxiliary components that provide display and storage options for tools and supplies.

Therefore, one principal object of the claimed invention is to provide a versatile means for positioning a suspended workpiece, permitting that workpiece to be raised, lowered, and rotated horizontally and/or vertically.

Another principal object of the claimed invention is to permit a workpiece to be laterally moved fully into or away from a working position.

Another principal object of the claimed invention is to provide light and magnifier sources.

Another principal object of the claimed invention is to provide for auxiliary components such as holders, supports, trays, and containers as would be useful for a given application.

Another principal object of the claimed invention is to provide a base system that can be configured for operation of the claimed invention from the left side or right side.

DESCRIPTION OF THE PREFERRED EMBODIMENTS

The embodiment of the claimed invention as presented in this section is a utility workstation adapted for needlework applications. It is made of wood so as to accomplish a generally traditional furniture look for the utility workstation that fits in well with needlework's typical home environment work setting.

Referring to FIG. 1, the work positioning part of the utility workstation 10 illustrated consists of a holding assembly 11, a headblock assembly 12, a crossbar assembly 13, an adjustable-arm lamp 14 with a built-in magnifier 15, a shaft assembly 16, a peg member 17, a column assembly 18, and a base assembly 19. A first tray member 20, second tray member 21, and storage container 22 are auxiliary components that have been incorporated into the basic work positioning device.

Referring to FIG. 2, the holding assembly 11 comprises a support member 23 having two threaded studs 24 perpendicularly projecting from one side for providing a standard means for accepting various types of holding and support attachments, and a standardized cylindrical mounting handle 25 perpendicularly projecting from the opposite side for pivotal insertion into an opening 26 in the end section of the headblock assembly 12. This opening 26 accepts various types of holding and support attachments employing the standardized mounting handle 25.

The first tray member 20 is used to display charts, patterns, magazines, and the like, and consists of a thin, metal backboard 27 fitted into a vertical slot 28 running the length of an elongated horizontal member 29 that mounts onto the top section of the headblock assembly 12. A thumbscrew 30 is passed through a washer 31 and one of two holes 32 in the horizontal member and into one of two embedded threaded inserts 33 in the headblock assembly 12. The pairs of mounting holes 32 and inserts 33 permit the same relative positioning of the first tray member 20 for both left side and right side configuration of the workstation. (Note the positions of the headblock assembly and first tray member in FIG. 6 & FIG. 7). A metal backboard 27 is employed because it allows small magnets and magnetic strips to be used to hold material against the backboard.

Referring to FIG. 3, a first opening 34 at the front end of the crossbar assembly 13 is for pivotally receiving the headblock assembly 12 which is mounted by passing an all-thread bolt 35 through an enlarged recessed lower portion 36 of the opening, an upper portion 37 of the opening, a washer 38, and into an embedded threaded insert 39 in the bottom section of the headblock assembly 12 followed by a washer 40 and a lock nut 41 that threads onto the all-thread bolt 35 to secure the headblock assembly 12. FIG. 4 shows a second opening 42 at the rear end of the crossbar assembly 13 for pivotally receiving the mounting shaft member 43 of the adjustable-arm lamp 14 and a third opening 44 between the first opening 34 and second opening 42 for pivotally mounting the crossbar assembly 13 onto the shaft assembly 16 by passing a bolt 45 through a flanged ball bearing 46 embedded in the enlarged upper portion 47 of the opening, the lower portion 48 of the opening, a washer 49, and into an embedded threaded insert 50 in the top section of the shaft assembly 16. The ball bearing 46 is used to improve rotational movement. A cap 51 covers the bolt head 52 and the ball bearing for aesthetic purposes.

Referring to FIG. 2, the second tray member 21 provides immediate access to such items as scissors, thread, needles, and the like, placed in the tray. The tray consists of an arm member 53 with a rectangular tray part 54 at one end and an opening 55 at the other end for pivotally mounting onto the bottom section 56 of the front end of the crossbar assembly 13.

The column assembly 18 receives the shaft assembly 16 through a first opening 57 at its upper end. Selective height adjustment of the shaft assembly 16 is accomplished by passing the peg member 17 through a second opening 58 at the upper end of the column assembly 18 and one of the several stops 59 in the shaft assembly 16.

The storage container 22 is used for storing such items as magazines, charts, fabric, notebook binders, floss boxes, and the like. In this embodiment, the storage container 22 is adhesively bonded to the column assembly 18 to create a sturdier base support structure. A rear leg member 60, support leg member, 61, and front leg member 62 of the base assembly 19 are attached to the storage container 22 and the column assembly 18 by passing bolts 63 through openings 64 in the leg members and into the bottom sections of the storage container 22 and the column assembly 18. The support leg member 61 connects at a first attachment point 65 with the rear leg member 60 and the front leg member 62 connects at a second attachment point 66 with the rear leg member 60 through alignment notches 67 located in the leg members. FIG. 5 shows threaded inserts 68 embedded in the bottom sections to receive the bolts 63 used to mount the leg members. The representation of the leg members as shown are arranged to provide the proper orientation of the leg members for right side use. FIG. 2 & FIG. 5 illustrate the arrangement for left side use. FIG. 6 presents an overhead view of the left side setup and includes an example of a scroll frame fabric holder 69. The scroll frame fabric holder 69 is a type of specialty holder for securing the fabric 70 used in needlework projects. The scroll frame 69 mounts onto the holding assembly 11 where a plate 71 and knobs 72 are employed for securing the holder in place. FIG. 7 presents an overhead view of the setup for right side use.

Referring back to FIG. 3, the mounting part of the second tray member 21 is illustrated in detail. As both the headblock assembly 12 and the second tray member 21 are mounted onto the same all-thread bolt 35, a flanged ball bearing 73 is embedded in an enlarged lower portion 74 of the arm opening 55 to improve rotational movement and ensure independent rotation of the two members. A washer 75 is interposed between the arm member 53 and the bottom section 56 of the crossbar assembly 13 to further improve movement. An all-thread bolt 35 is employed because it is a simple way of providing a threaded stud 76 that projects below the bottom section 56 of the crossbar assembly 13. This allows the use of a wing nut 77 to secure the second tray member 21, thereby simplifying the installation of this tray which is removed when the workstation 10 is boxed for shipping or general transport, as when taken along on a trip or vacation. In the absence of a tray or the like at this location, or if a different, separate mounting means was to be employed for mounting auxiliary components here, a standard bolt or bolts could replace the all-thread bolt 35.

FIG. 8 illustrates a mechanism within the headblock assembly 12 for maintaining the holding assembly and various other holding and support means at a fixed position. A thumbscrew 78 is advanced through a threaded insert 79 to make contact with a friction bar member 80 which presses against the mounting handle 25 to lock the handle in place. The friction bar member 80 fits generally within a slot 81 abutting the headblock assembly opening 26 where its movement is restricted to ranging between being completely out of the opening 26 and being partially into the opening 26. The friction bar member 80 movement is restricted by a pair of vertical posts 82 located within the slot 81 area that pass through openings 83 in the friction bar member 80 to serve as stops for this member.

In FIG. 9, an alternate embodiment of the utility workstation 84 is illustrated which shows a basic work positioning device consisting of a headblock assembly 85, a crossbar assembly 86, a lamp 87 and magnifier 88, a shaft assembly 89, a peg member 90, a column assembly 91, and a base assembly 92 comprising a plate member 93, a rear leg member 94, a support leg member 95, and a front leg member 96. A rotatable, universal support attachment 97 is included to illustrate a holding and support means which inserts directly into the headblock assembly 85. The column assembly 91 shown is a modified form of the column assembly 18 utilized in the needlework utility workstation embodiment and represents a typical embodiment for this assembly.

As illustrated in FIG. 10, the plate member 93 is mounted onto the bottom section 98 of the column assembly 91 by bolts 99. The rear leg member 94, support leg member 95, and front leg member 96 are attached to the plate member 93 by passing bolts 100 through openings 101 in the leg members and into threaded openings 102 in the plate member 93. These openings 102 are arranged so as to properly orient the leg members for left side or right side use. Auxiliary components can be mounted directly onto the plate member 93 or, absent leg members, the plate member 93 can be mounted directly onto a floor or other type support surface.

FIG. 11 presents a detailed view of the scroll frame 69 shown earlier in FIG. 6 & FIG. 7. The scroll frame 69 consists of two lockbars 103, two scroll rods 104, and two sidebars 105, and is used to scroll fabric or other material. One end of a piece of fabric or the like is laid over a slot 106 in the scroll rod 104 such that it extends slightly beyond the slot 106. A lockbar 103 is placed over the fabric, and pressed down into the slot 106, carrying the fabric along with it. This operation is repeated for the other end of the material using the remaining scroll rod 104 and lockbar 103.

The sidebar 105 is made up of two half-sections 107 held in alignment by bolts 108 that pass through first openings 109 in the half-sections 107 and terminate in threaded knobs 110. Second openings 111 receive the ends of the scroll rods 104, and third openings 112 allow the scroll frame 69 to be mounted onto the holding assembly 11 as shown in FIG. 6 & FIG. 7. The openings for the scroll rods 104 and the holding assembly 11 are arcs in each of the half-sections 107 that form circular openings because one half-section 107 is inverted with respect to the other. First arcs 113 in the second openings 111 are of a radius such that the two half-sections 107 form an opening having a diameter approximately that of the scroll rods 410. However, the depth of the first arcs 113 is such that a small gap 114 exists between the half-sections 107 that permit a clamping action to be exerted on the scroll rods when the threaded knobs 110 are advanced on the alignment bolts 108. Second arcs 115 of a radius slightly greater than that of the threaded studs 24 of the holding assembly 11 create third openings 112 in the sidebar 105 for easy mounting of the scroll frame 69 onto the holding assembly 11.

The fabric, having been secured in the scroll rods 104 by the lockbars 103, is now scrolled on the scroll rods 104 until the distance between the two rods is approximately that of the space between the second openings 111. The ends of the scroll rods 104 are inserted into the second openings 111 of the sidebars 105, and one of the scroll rods 104 is clamped in place by advancing either the upper pair of threaded knobs 110 or the lower pair. The fabric is further wrapped around the unclamped scroll rod 104 until the fabric is taut. Once taut, the unclamped rod is then clamped in place. The scroll frame 69 is mounted onto the holding assembly 11, which in turn is mounted onto the headblock assembly 12. The fabric is scrolled up or down on the scroll frame 69 by loosening the threaded knobs 110, scrolling the fabric up or down, and retightening the threaded knobs 110.

Figure 1:
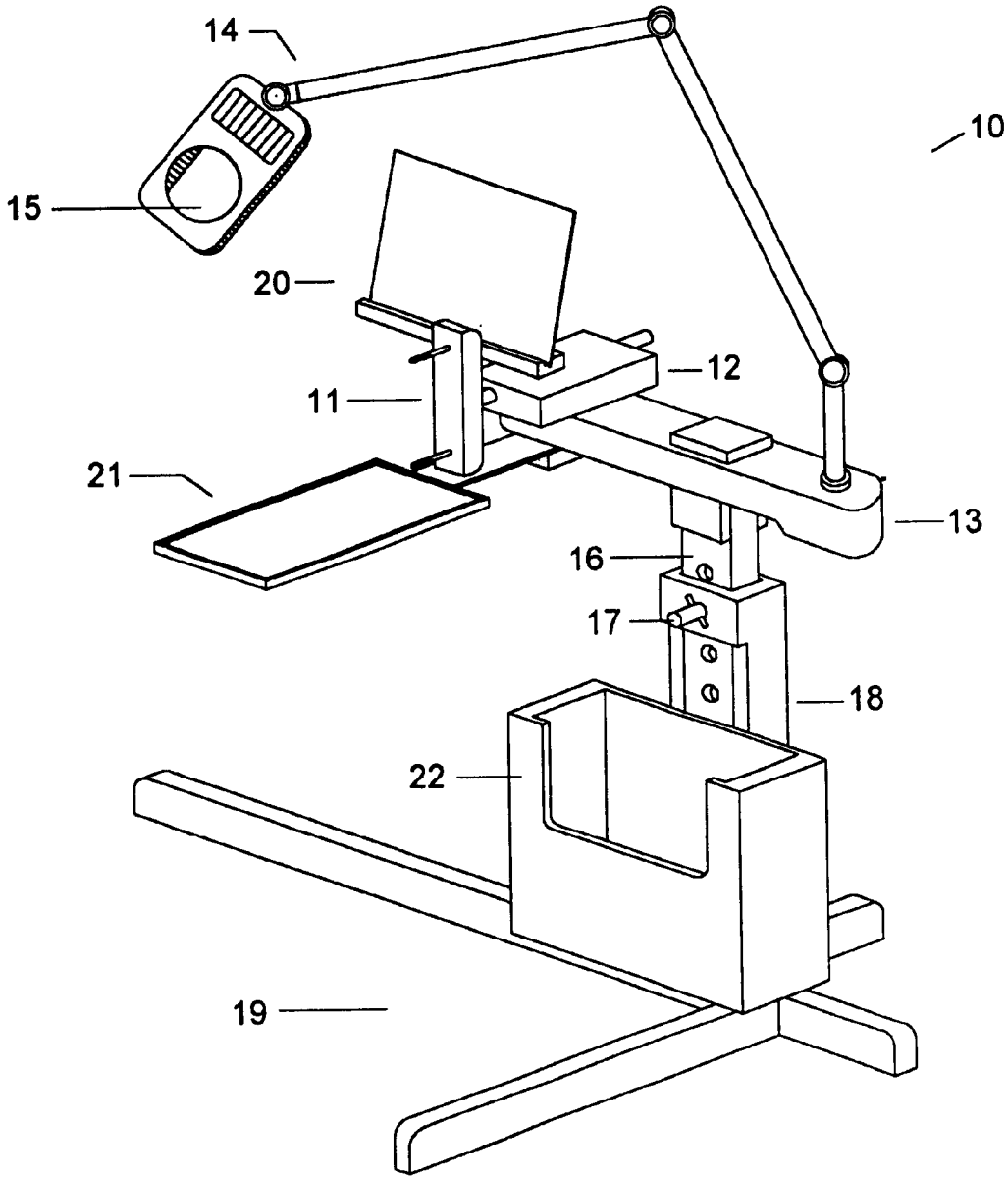
FIG. 1 is a perspective view of the utility workstation adapted for needlework use.
Figure 2:
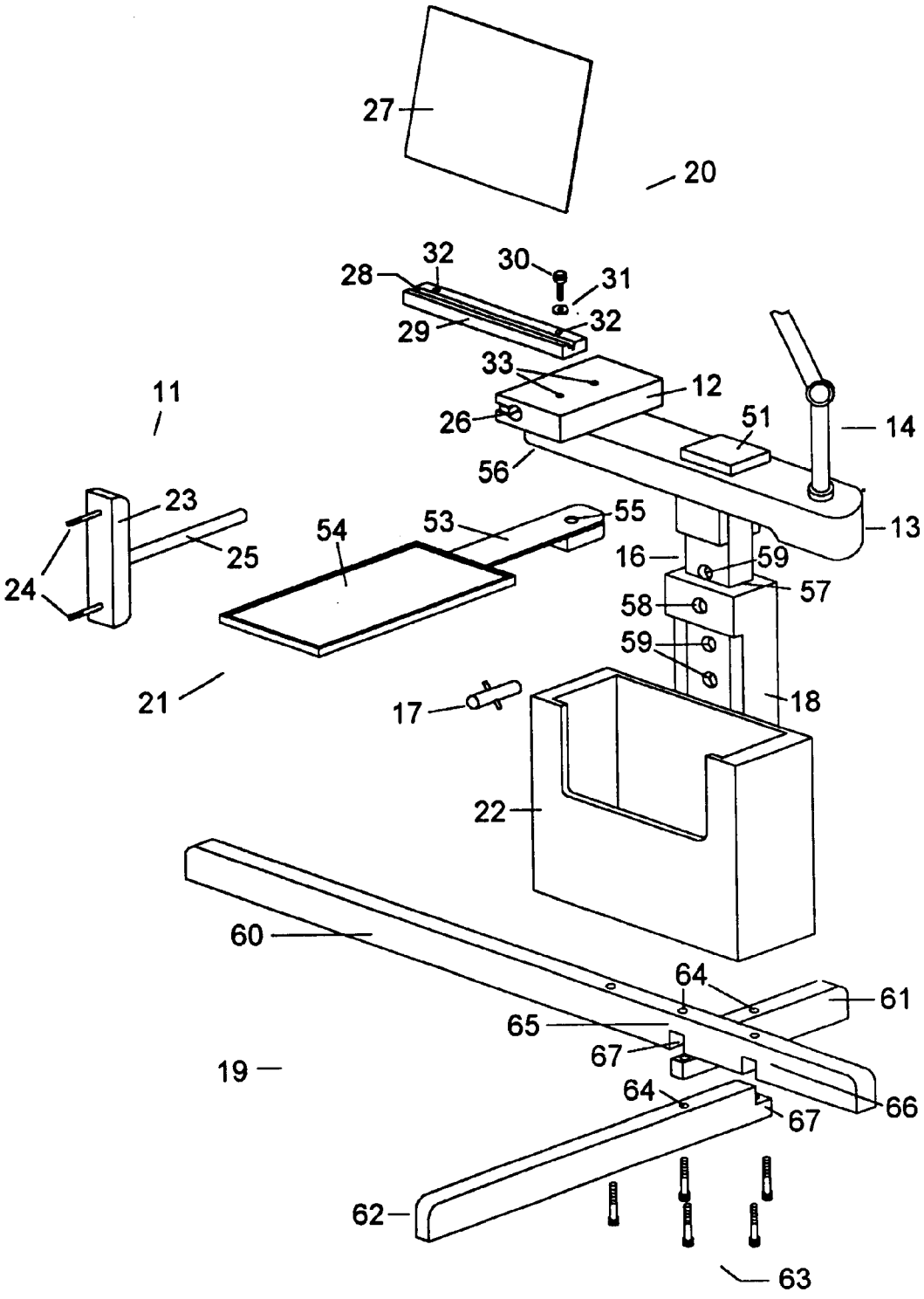
FIG. 2 is a partially exploded perspective view of the utility workstation illustrated in FIG. 1.
Figure 3:
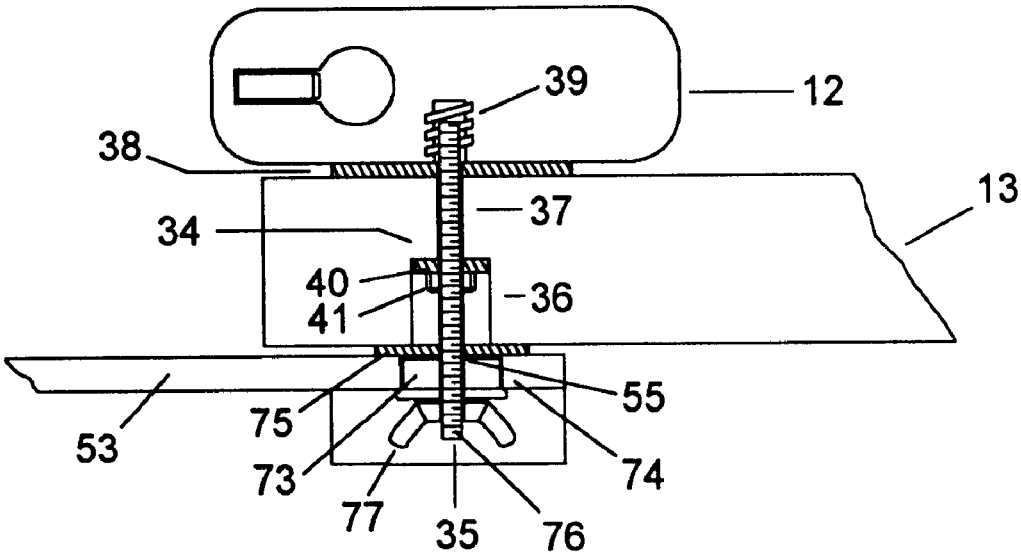
FIG. 3 is an enlarged cross-sectional view of the front end of the crossbar assembly showing the members that are mounted within this area.
Figure 4:
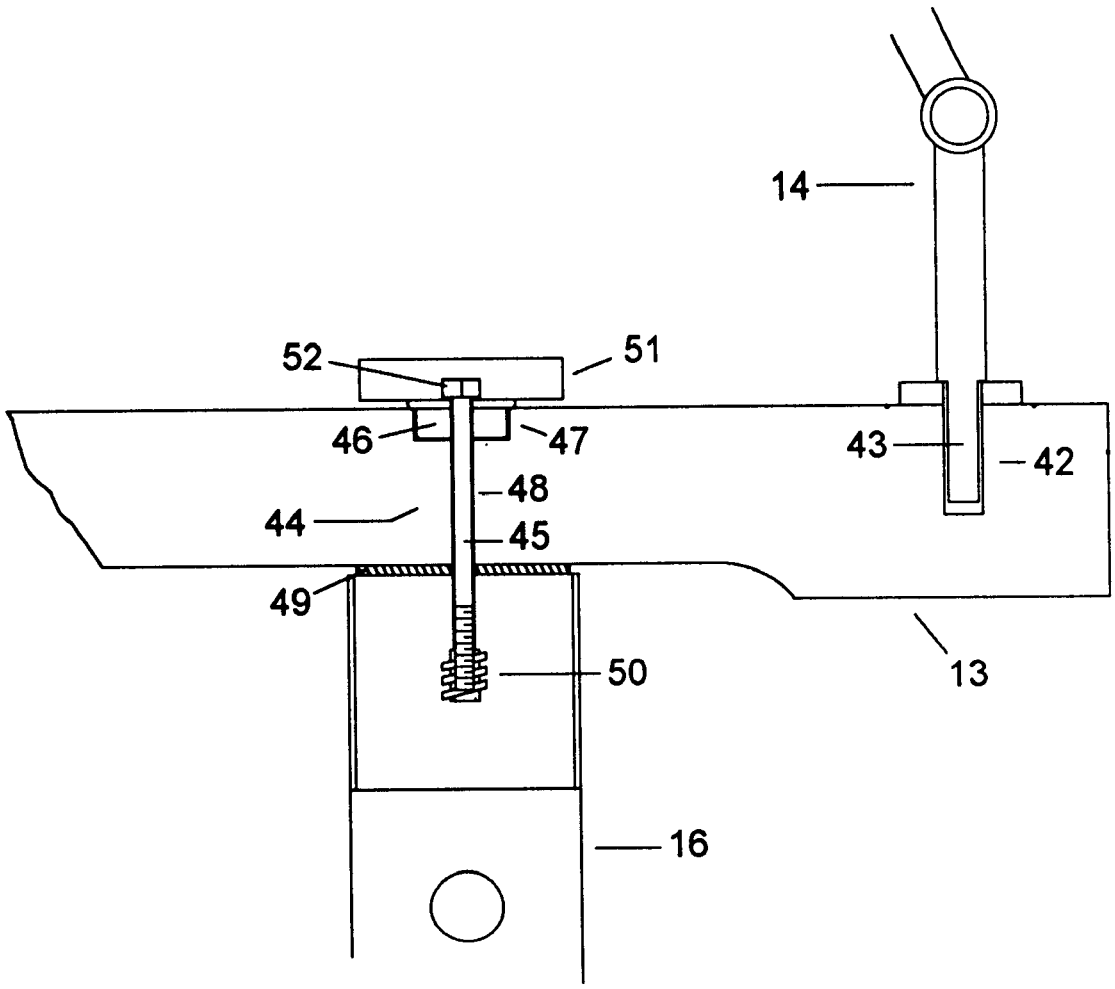
FIG. 4 is an enlarged cross-sectional view of the middle and end sections of the crossbar assembly showing the members that are mounted within this area.
Figure 5:
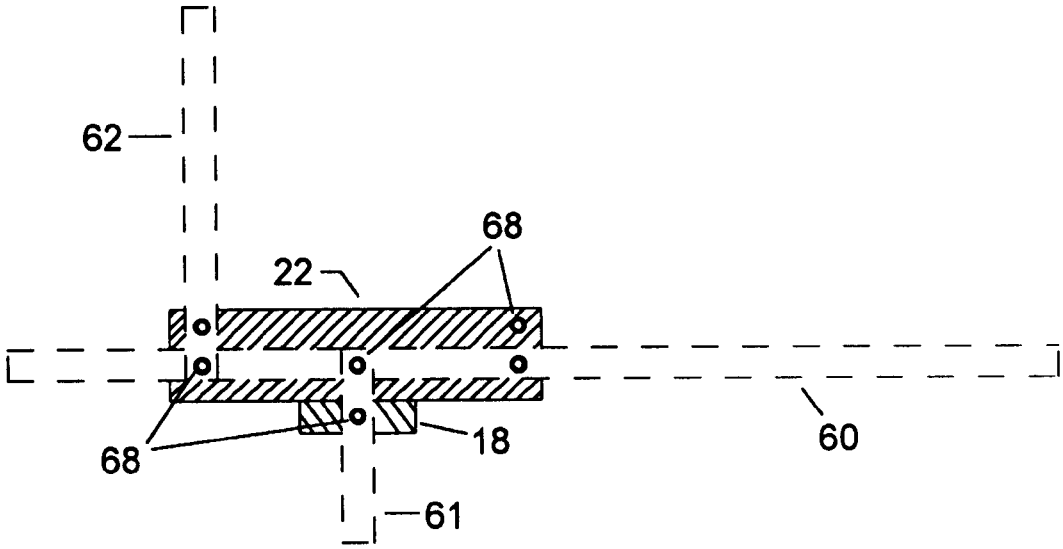
FIG. 5 is a sectional view of the bottom sections of the storage container and the column assembly showing how leg members are mounted.
Figure 6:
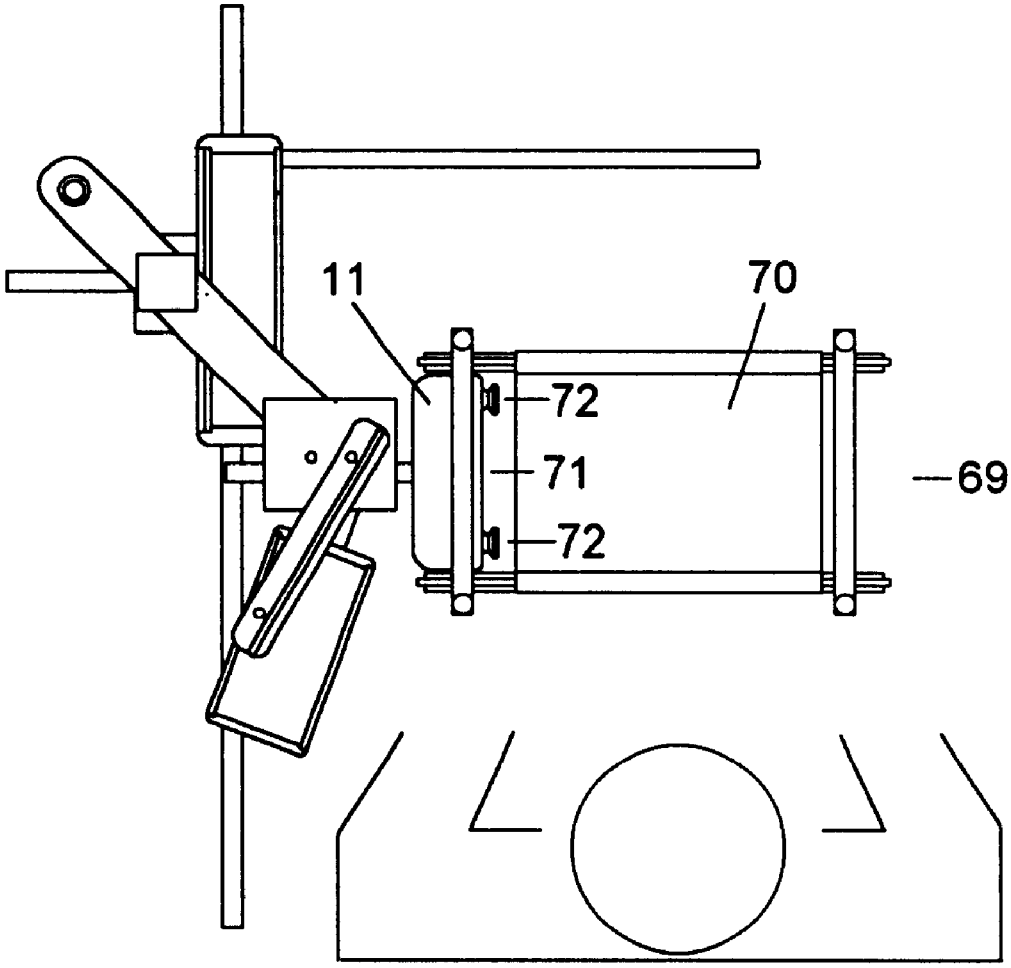
FIG. 6 is a top plan view of the utility workstation and a specialty holder configured for left side utilization.
Figure 7:
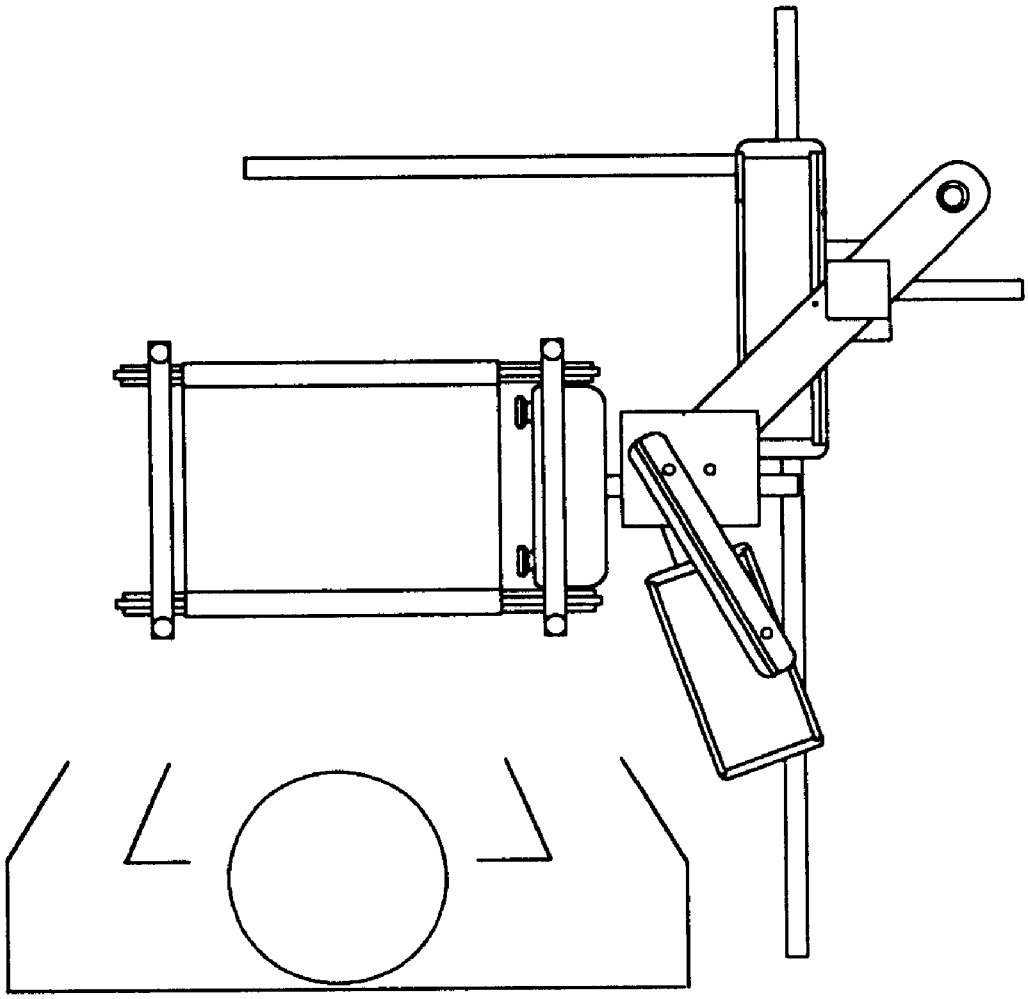
FIG. 7 is a top plan view of the utility workstation and a specialty holder configured for right side utilization.
Figure 8:
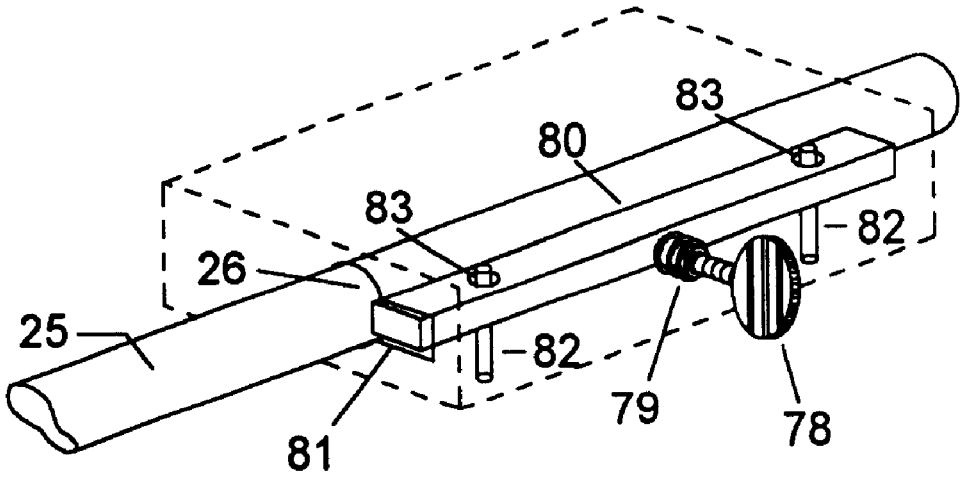
FIG. 8 is an enlarged perspective view of the headblock assembly holding mechanism.
Figure 9:
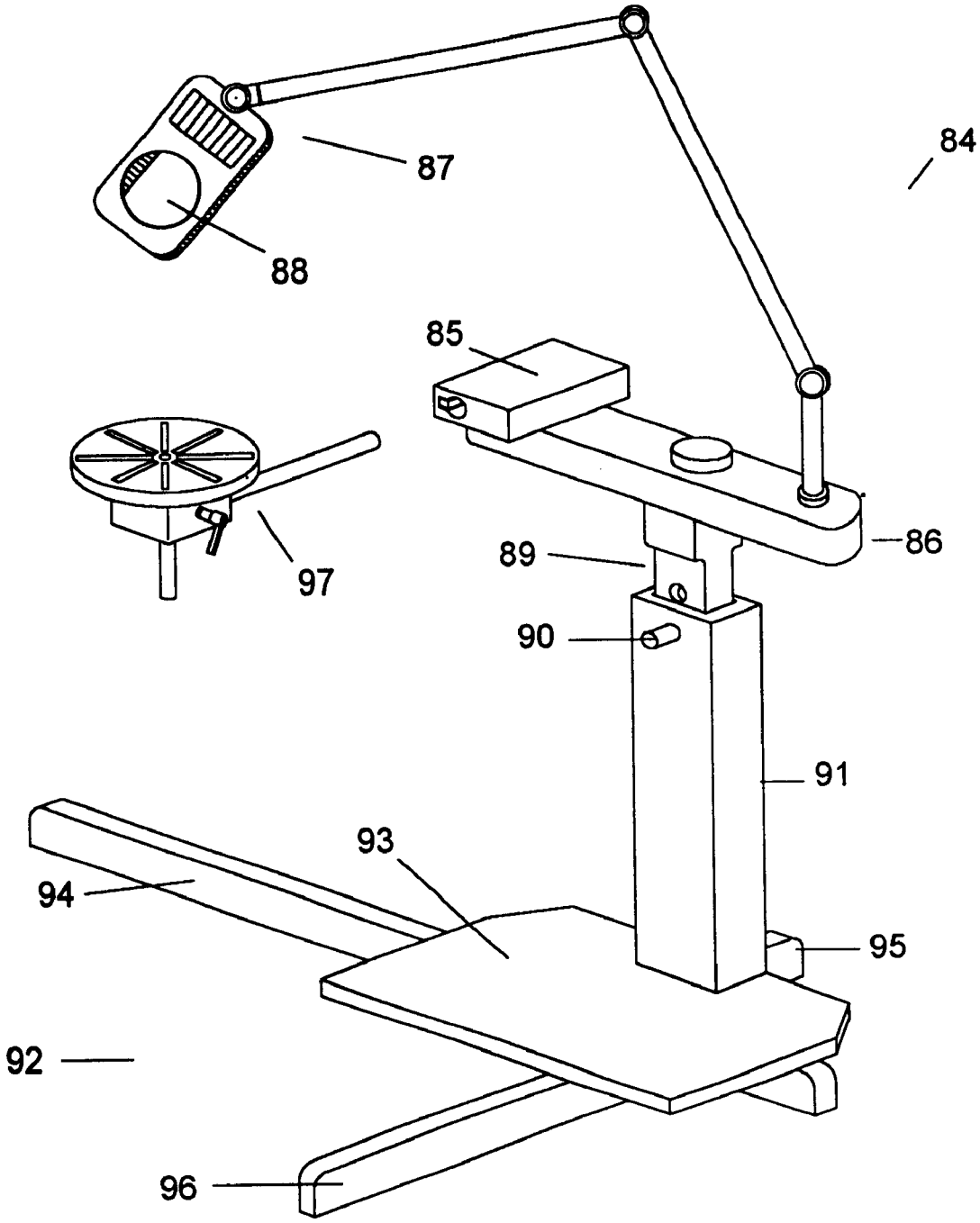
FIG. 9 is a perspective view of an alternate embodiment of the utility workstation.
Figure 10:
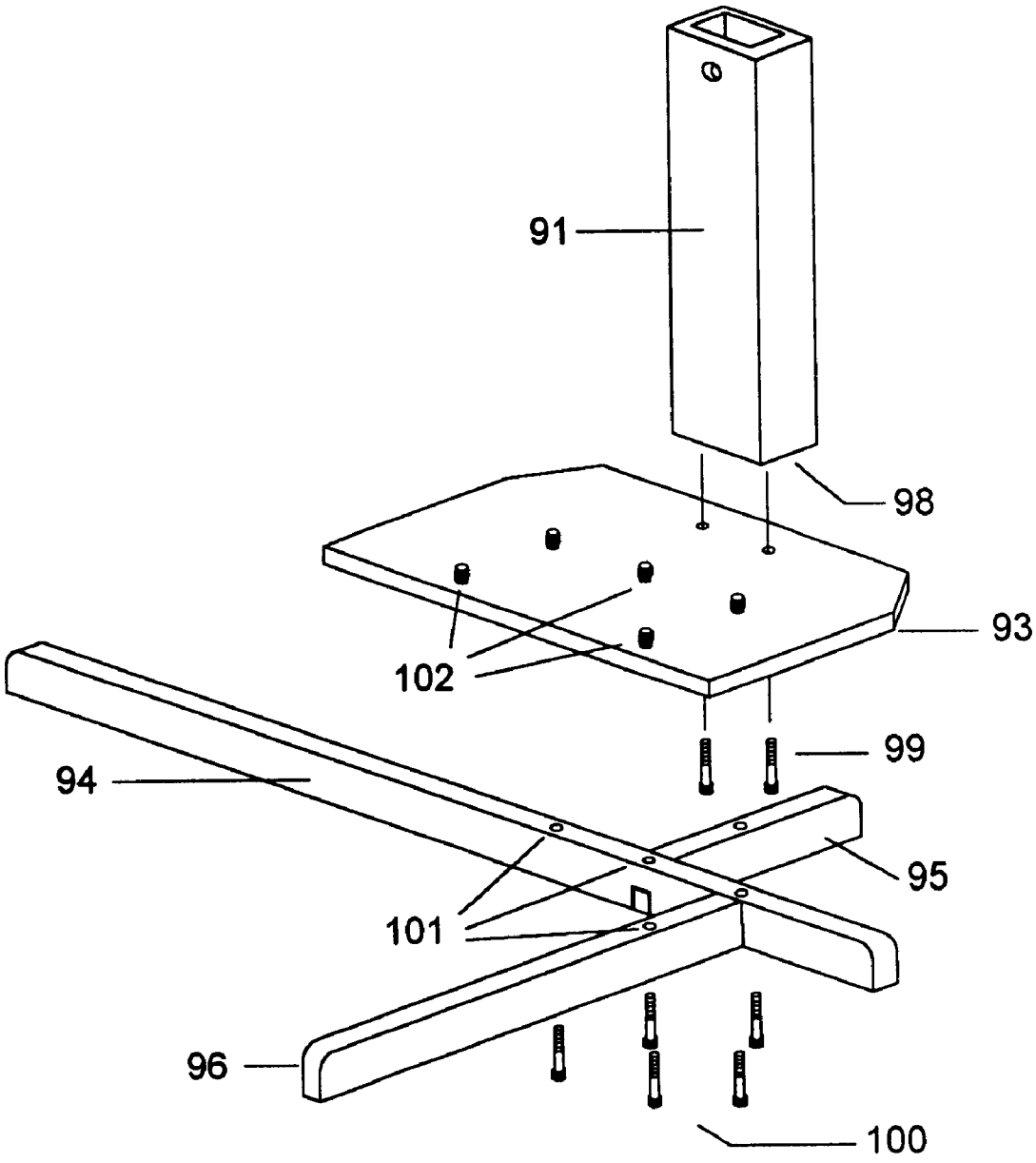
FIG. 10 is an exploded perspective view of the structural base support members of the alternate embodiment illustrated in FIG. 9.
Figure 11:
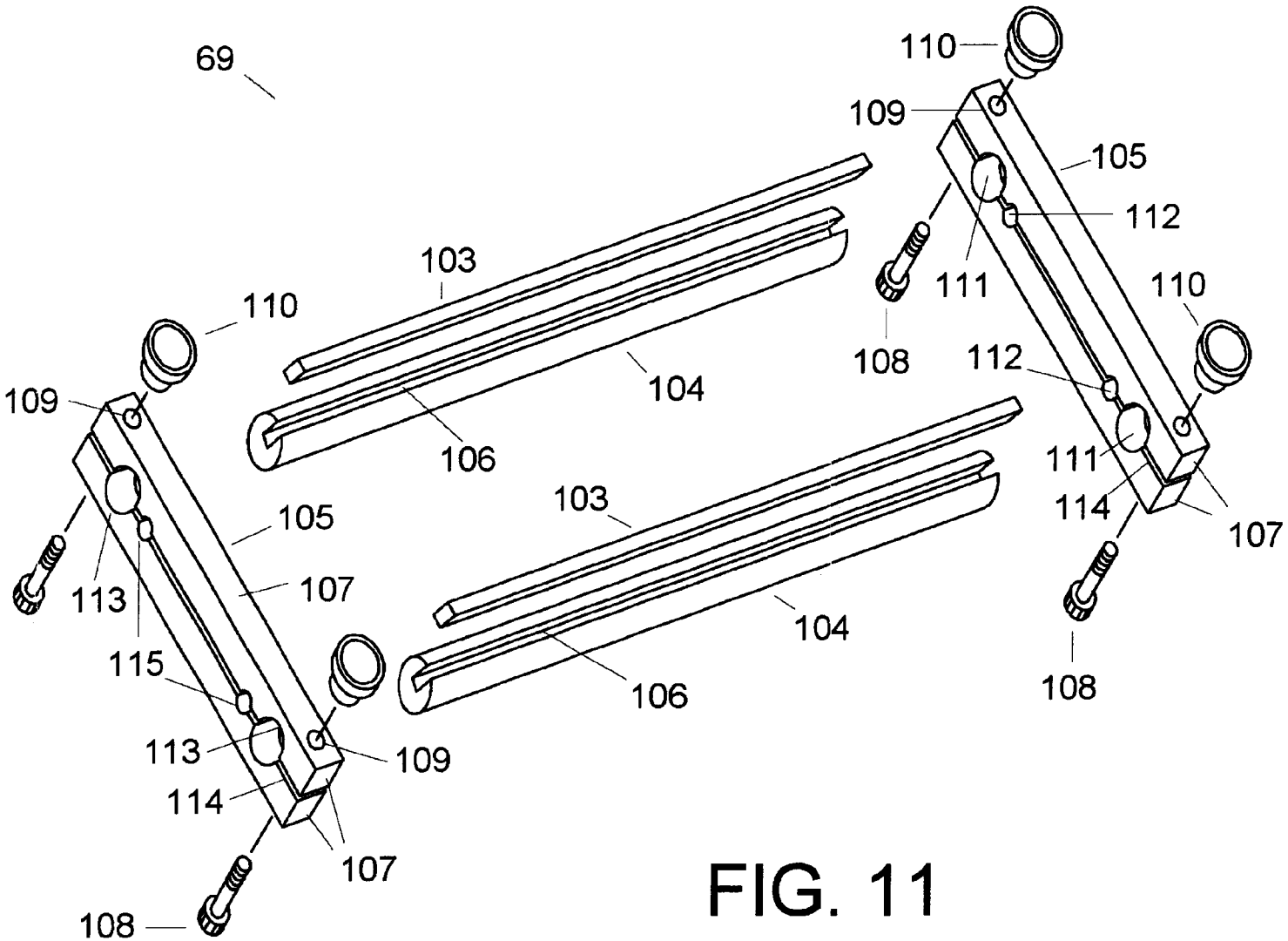
FIG. 11 is a perspective view of the scroll frame members.

I claim:

1. A utility workstation comprising:

a holding assembly comprising work holding means for accepting a workpiece and mounting means for detachably, rotatably attaching said work holding means wherein said holding assembly includes a plurality of attachments variously configured for various sundry workpieces;

a headblock assembly comprising a rotatable, horizontally disposed support member having means for detachably, vertically rotatably receiving said mounting member of said holding assembly wherein friction means comprising a friction bar member is employed for maintaining said holding assembly at a stationary position;

a crossbar assembly comprising a rotatable, horizontally disposed support member having means for receiving sad headblock assembly;

a shaft assembly comprising a vertically disposed support member having means for receiving said crossbar assembly whereby said holding assembly, said headblock assembly, said crossbar assembly, and said shaft assembly in combination allow said workpiece to be swiveled without adjustment from a retracted position to a working position where said workpiece is suspended at a chosen location and orientation within the range permitted by said assemblies; and a base assembly.

2. The utility workstation defined in claim 1 with a column assembly, said column assembly comprising a vertically disposed support member having means for adjustably receiving said shaft assembly.

3. The utility workstation defined in claim 1 with illumination means.

4. The utility workstation defined in claim 1 with magnification means.

5. The utility workstation defined in claim 1 with one or more tray members.

6. The utility workstation defined in claim 1 with one or more storage members.

7. The utility workstation defined in claim 1 wherein said work holding member of said holding assembly comprises a frame.

8. The utility workstation defined in claim 7 wherein said frame comprises a scroll frame.

9. The utility workstation defined in claim 1 wherein said mounting means of said holding assembly comprises an elongated cylindrical extension and said friction bar member comprises a bar member intersecting an opening in said headblock assembly for introducing optional variable frictional contact along the length of said mounting means.

10. The utility workstation defined in claim 1 wherein said work holding member of said holding assembly comprises a rotating table assembly, said rotating table assembly comprising a rotatable table member having means for receiving a workpiece and a receiving block member having means for adjustably receiving said table member, said rotatable table member having openings for accepting fasteners, clamps, jigs, and the like.

11. The utility workstation defined in claim 1 wherein said base assembly comprises a side leg member for extending front-to-rear alongside the side part of a seating means, a front leg member transversely connected to said side leg member for extending alongside the front part of said seating means, and a support leg member transversely connected to said side leg member oppositely disposed to said front leg member for extending at an opposing right angle to said side part of said seating means.

12. A utility workstation comprising:

a holding assembly comprising work holding means for accepting a workpiece and mounting means for detachably, rotatably attaching said work holding means wherein said holding assembly includes a plurality of attachments variously configured for various and sundry workpieces;

a headblock assembly comprising a rotatable, horizontally disposed support member having means for detachably, vertically rotatably receiving said mounting member of said holding assembly wherein means is employed for maintaining said holding assembly at a stationary position;

a crossbar assembly comprising a rotatable, horizontally disposed support member having means for receiving said headblock assembly;

a shaft assembly comprising a vertically disposed support member having means for receiving said crossbar assembly;

a column assembly comprising a vertically disposed support member having means for adjustably receiving said shaft assembly whereby said holding assembly, said headblock assembly, said crossbar assembly, said shaft assembly, and said column assembly in combination allow said workpiece to be swiveled from a retracted position to a working position where said workpiece is suspended at a chosen location and orientation within the range permitted by said assemblies;

a base assembly;

one or more tray members;

one or more storage members;

illumination means;

magnification means; and means for affixing said illumination and magnification means.

13. The utility workstation defined in claim 12 wherein said work holding member of said holding assembly comprises a frame.

14. The utility workstation defined in claim 13 wherein said frame comprises a scroll frame.

15. The utility workstation defined in claim 12 wherein said work holding member of said holding assembly comprises a rotating table assembly.

16. A utility workstation comprising:

a holding assembly comprising work holding means for accepting a workpiece and mounting means for detachably, rotatably attaching said work holding means, said work holding means comprising a scroll frame comprising scroll rods for securing material and sidebars for securing said scroll rods, said sidebars having openings for receiving said scroll rods wherein means are employed for retaining said scroll rods when knobs or the like connected to said sidebars are advanced, said scroll rods comprising a rod and a lockbar wherein said lockbar comprises a bar member and said rod comprises a rod member having a slot along its length for receiving said lockbar whereby material is placed over said slot and pressed thereinto by said lockbar;

a headblock assembly comprising a rotatable, horizontally disposed support member having means for detachably, vertically rotatably receiving said mounting member of said holding assembly;

a headblock assembly comprising a rotatable, horizontally disposed support member having means for detachably, vertically rotatably receiving said mounting member of said holding assembly;

a crossbar assembly comprising a rotatable, horizontally disposed support member having means for receiving said headblock assembly;

a shaft assembly comprising a vertically disposed support member having means for receiving said crossbar assembly;

a column assembly comprising a vertically disposed support member having means for adjustably receiving said shaft assembly whereby said holding assembly, said headblock assembly, said crossbar assembly, said shaft assembly, and said column assembly in combination allow said scroll frame to be swiveled from a retracted position to a working position where said scroll frame is suspended at a chosen location and orientation within the range permitted by said assemblies;

a base assembly; and a tray member with a vertically disposed slot for receiving a backboard adjustably mounted onto said headblock assembly.

17. The utility workstation defined in claim 16 with illumination means.

18. The utility workstation defined in claim 16 with magnification means.

19. The utility workstation defined in claim 16 with one or more additional tray members.

20. The utility workstation defined in claim 16 with one or more storage members.

21. A utility workstation comprising:

a holding assembly comprising work holding means for accepting a workpiece and mounting means for detachably, rotatably attaching said work holding means, said work holding means comprising a scroll frame comprising scroll rods for securing material and sidebars for securing said scroll rods, said sidebars comprising sectional members having complementary openings for receiving said scroll rods wherein a gap exists fully between said sectional members when knobs or the like connected to said sectional members are advanced to retain said scroll rods, and said scroll rods comprising a rod and a lockbar wherein said lockbar comprises a bar member and said rod comprises a rod member having a slot along its length for receiving said lockbar whereby material is placed over said slot and pressed thereinto by said lockbar;

a headblock assembly comprising a rotatable, horizontally disposed support member having means for detachably, vertically rotatably receiving said mounting member of said holding assembly;

a crossbar assembly comprising a rotatable, horizontally disposed support member having means for receiving said headblock assembly and said second tray member;

a shaft assembly comprising a vertically disposed support member having means for receiving said crossbar assembly;

a column assembly comprising a vertically disposed support member having means for adjustably receiving said shaft assembly whereby said holding assembly, said headblock assembly, said crossbar assembly, said shaft assembly, and said column assembly in combination allow said scroll frame to be swiveled from a retracted position to a working position where said scroll frame is suspended at a chosen location and orientation within the range permitted by said assemblies;

a base assembly;

a tray member adjustably mounted onto said crossbar assembly; and a tray member with a vertically disposed slot for receiving a backboard adjustably mounted onto said headblock assembly.

22. A utility workstation comprising:

a holding assembly comprising work holding means for accepting a workpiece and mounting means for detachably, rotatably attaching said work holding means, said work holding means comprising a rotating table assembly comprising a rotatable table member having means for receiving a workpiece and a rotatable receiving block member having means for adjustably receiving said table member, said rotatable table member having openings for accepting fasteners, clamps, jigs, and the like;

a headblock assembly comprising a rotatable, horizontally disposed support member having means for receiving said holding assembly;

a crossbar assembly comprising a rotatable, horizontally disposed support member having means for rotatably receiving said headblock assembly;

a shaft assembly comprising a vertically disposed support member having means for receiving said crossbar assembly;

a column assembly comprising a vertically disposed support member having means for adjustably receiving said shaft assembly whereby said holding assembly, said headblock assembly, said crossbar assembly, said shaft assembly, and said column assembly in combination allow said rotating table assembly to be swiveled from a retracted position to a working position where said rotating table assembly is suspended at a chosen location and orientation within the range permitted by said assemblies;

and a base assembly.

* * * * *